United States Patent [19]

Daniels

[11] Patent Number: 5,073,251

[45] Date of Patent: Dec. 17, 1991

[54] METHOD OF AN APPARATUS FOR RECOVERING OIL FROM SOLID HYDROCARBONACEOUS MATERIAL

[76] Inventor: Ludlow S. Daniels, 12 Ricardo La., Mill Valley, Calif. 94941

[21] Appl. No.: 436,934

[22] Filed: Nov. 13, 1989

Related U.S. Application Data

[63] Continuation of Ser. No. 307,193, Feb. 3, 1989, abandoned, which is a continuation of Ser. No. 183,261, Apr. 8, 1988, abandoned, which is a continuation of Ser. No. 543,260, Oct. 19, 1983, abandoned.

[30] Foreign Application Priority Data

| | | | |
|---|---|---|---|
| Oct. 19, 1982 | [AU] | Australia | PF6415 |
| Oct. 19, 1982 | [AU] | Australia | PF6416 |
| Oct. 19, 1982 | [AU] | Australia | PF6417 |

[51] Int. Cl.[5] ..... C10G 1/00

[52] U.S. Cl. ..... 208/407; 208/410; 208/411; 208/154; 201/31

[58] Field of Search ..... 208/407, 409, 410, 411, 208/154; 201/27, 29, 31; 122/4 D

[56] References Cited

U.S. PATENT DOCUMENTS

| | | | |
|---|---|---|---|
| 2,023,815 | 12/1952 | Roetheli et al. | 201/31 X |
| 2,618,588 | 11/1952 | Jahnig | 201/31 X |
| 2,618,589 | 11/1952 | Nicholson et al. | 201/31 X |
| 3,784,462 | 1/1974 | Frick | 208/11 R |
| 4,199,432 | 4/1980 | Tamm et al. | 208/11 R |
| 4,246,093 | 1/1981 | Wolcott, Jr. | 208/8 R |
| 4,258,005 | 3/1981 | Ito et al. | 201/31 X |
| 4,311,580 | 1/1982 | Bartholic | 208/DIG. 1 |
| 4,415,430 | 11/1983 | York | 208/11 R X |
| 4,430,195 | 2/1984 | Oltrogge | 208/8 R |
| 4,481,100 | 11/1984 | Kennedy et al. | 208/411 |

*Primary Examiner*—Anthony McFarlane
*Attorney, Agent, or Firm*—Ladas & Parry

[57] ABSTRACT

A method for the recovery of oil from solid hydrocarbonaceous material and particularly from oil shale by retorting fresh feed shale and heat medium particles using a fluidized bed. The invention uses a self supporting dense phase fluidized bed in a retort without the need to use an external fluid for fluidization.

Also described is a control system for the method whereby feed stock input rate is controlled as a function of flow rate of oil vapour products given off, and whereby heat medium particle input rate is controlled as a function of the temperature of either the retort bed or of the oil vapor product.

8 Claims, 4 Drawing Sheets

METHOD OF AN APPARATUS FOR RECOVERING OIL FROM SOLID HYDROCARBONACEOUS MATERIAL

This is a continuation of copending application(s) Ser. No. 07/307,193 filed on Feb. 3, 1989, now abandoned, which is a continuation of application Ser. No. 07/183,261 filed on Apr. 8, 1988 (now abandoned) which is a continuation of application Ser. No. 06/543,260 filed on Oct. 19, 1983 (now abandoned).

BACKGROUND OF THE INVENTION

This invention relates to a method of and apparatus for use in recovering oil from solid hydrocarbonaceous material. The invention has particular application in the recovery of shale oil from oil shale, and the invention is hereinafter described in such context, but it will be understood that the invention also has applications in the recovery of oil from other solid hydrocarbonaceous materials such as coal and tar sands.

In general terms, the invention flows from a realisation of the inventor that feedstock in the form of fresh oil shale particles may be contacted with hot recirculated heat medium shale in a reaction bed to form a self-sustaining dense phase fluidized bed. By contacting the fresh feed shale and the hot recirculating heat medium shale, the kerogen content of the feed shale particles is converted into gas and oil vapour products which are released at all levels throughout the reaction bed, whereby a fluidized bed is created without there being a need to introduce an appreciable amount of an external fluid, such as gas or steam, to sustain the fluidized bed.

Fluidized bed processing is used extensively in arts which may be considered vaguely related to the present invention. Thus, the Winkler coal gasification process employs a fluidized bed in which crushed coal is reacted with oxygen and steam to produce a fuel gas which is rich in carbon monoxide and hydrogen. Also, in fluid catalytic cracking plants fluidization is effected in reaction vessels by oil vapours and in catalyst regeneration vessels by combustion supporting air which is admitted for carbon burning. Furthermore, a number of prior art paper proposals have discussed the use of fluidized bed retorting for recovery of shale oil.

However, in all of the operational fluidized bed retorting processes of which the inventor is aware, fluidization of the beds is effected and sustained by the admission of substantial amounts of an external fluid. This is to be contrasted with the present invention in which fluidization is effected and sustained by a reaction of dry solids, with the fluidizing medium being constituted by gas and vapour products released in the reaction and without there being a need to admit significant amounts of external fluids other than under start-up conditions.

It is a disadvantage of fluidized bed processes using an external fluid to fluidize the bed, that the external fluid must be separated from the effluent vapour given off from the bed before the effluent varpour may be refined into end product. It also requires a supply of energy to provide and sustain the external fluid and to introduce that fluid under pressure into the fluidized bed.

SUMMARY OF THE INVENTION

It is therefore an object of the present invention to provide a method of recovering oil from solid hydrocarbonaceous material, and apparatus therefore, which will obviate or minimise the foregoing disadvantages in a simple yet effective manner, or which will at least provide the public with a useful choice.

Accordingly, in one aspect the invention consists in a method of recovering oil from solid hydrocarbonaceous material and which comprises the steps of:

contacting fresh feed hydrocarbonaceous material particles with heat medium particles in a dense phase fluidized bed, with the fluidizing medium for the bed being generated within the bed and being constituted at least primarily by fluid released by conversion of kerogen in the feed material, withdrawing from the bed oil vapour which is produced as a result of heat exchange between the heat medium particles and the feed particles, progressively withdrawing the heat medium particles and spent feed material particles from the fluidized bed, heating the heat medium particles in a heating region external of the fluidized bed, and recirculating the heated particles through the fluidizing bed with fresh feed material particles.

More specifically the invention consists in a method of recovering shale oil from oil shale, comprising the steps of:

contacting feed shale particles with recirculated heat medium shale particles in a dense phase fluidized bed, with the fluidizing medium for the bed being generated within the bed and being constituted at least primarily by fluid released by conversion of kerogen in the shale particles, withdrawing from the fluidized bed shale oil vapour which is produced as a result of heat exchange between the heat medium shale and the feed shale particles, progressively withdrawing the heat medium shale and spent feed shale particles from the fluidized bed, heating said heat medium shale and spent feed shale particles in a region external of the fluidizing bed, and recirculating the heated particles through the fluidizing bed with fresh feed shale particles.

In a further aspect the invention consists in apparatus for recovering shale oil from oil shale, said apparatus comprising a retort adapted to contain a dense phase fluidized bed, a combustor arranged to receive spent feed shale and recirculating heat medium shale from said retort and to combust the residual carbon therein in the presence of a combustion supporting gas, flow control means arranged to return controlled amounts of recirculated heat medium shale from said combustor to said retort, feed means adapted to feed fresh feed shale particles into said retort, and extraction means adapted to extract shale oil vapour from said retort.

A distributor grid, pipe manifold or similar such device would normally be incorporated in the retort for injecting a fluidizing medium in the form of steam or an inert or fuel gas, so that the feed shale particles and recirculating heat medium particles may be fluidized during an initial start-up phase of the apparatus. However, it is to be understood that when the fluidized bed has been established, following the start-up period, it will be self-sustaining without the need for continued admission of significant amounts of an external fluidizing medium, and this is the primary distinction between the present invention and the known prior art.

Although the fluidized bed itself will be self-sustaining at the conclusion of the start-up period, it will be understood that a small flow of purging gas or steam will need be maintained through the distributor at all times during plant operation to prevent the distributor from becoming plugged with solids. Similarly, in accordance with conventional practice in fluidized solids plants, purge or blowback flows of gases or steam will need be directed to all instrument, aeration and similar connections into the system to prevent localised plugging. The purge or blowback flows of gases or steam are turned-on before solids are directed into the equipment and are kept flowing for as long as plant operation continues. Furthermore, important control measurement connections are fitted with block valves, packing glands and retractable reamers or drills so that any plugs which may form can be cleared and plant operation continued without enforced shutdown occurring.

The heat medium shale and spent feed shale particles are preferably heated in a combustor device by burning residual carbon on or in such particles in the presence of a combustion supporting gas. The combustor device may take various forms, depending on the scale requirements of a shale oil recovery plant in any given situation. For example, in a plant which is used for processing rich shale and which has a relatively low output requirement, say, 5,000 barrels per day, it would be practicable to employ a dense phase carbon combustor. However, it is preferred that the combustor should comprise a dilute phase combustor, referred to herein as a transport combustor, in which combustion supporting air is admitted to entrain spent and recirculating shale particles and to transport such particles whilst carbon burning proceeds.

The transport combustor operates at relatively high gas velocities, in contrast with dense phase fluidized bed combustors which must be limited to low gas velocities to avoid excessive entrainment of solids in the departing gases. Therefore, quite large commercial scale plants can be built, having a capacity in the order of 50,000 barrels per day and greater, using the combination of a dense phase retort and a dilute phase combustor as proposed by the present invention. In this context it is observed that, in typical shale processing operations where all or most of the residual carbon with spent shale is burned as a fuel, the volume of the flue gases evolved in a combustor will be many times greater than the volume of product gases and vapours released in the retorting section. A very large fluidized bed shale processing plant could be built with a single dense bed retort and several dense bed combustors, say, ten in parallel, but this would be a complex and costly alternative to the arrangement proposed by the present invention. A single dense bed reactor for such a plant might need to be in the order of 50 meters diameter and such a reactor size would involve process vessel design factors beyond those which have yet been experienced.

Heat transfer devices may be located along the length of the transport combustor so that combustion heat in excess of the retort process heat requirements can be recovered for steam generation or other heating requirements. It is desirable, from a heat efficiency standpoint, to operate the transport combustor at the highest temperature levels that can be accommodated whilst staying within limits set by, for example, shale sintering temperatures and refractory durability considerations. This can be accomplished by adding measured and controlled amounts of combustion supporting air at successive points along the transport combustor length. The heat transfer or recovery surfaces which also are located along the length of the combustor remove heat from the entraining gas and recirculating shale solids whilst the added air allows the combustion of corresponding amounts of carbon to hold the transport combustor temperature close to the permissible operating limits. This is to ensure that carbon combustion on and in the spent and recirculating shale particles will occur at a high rate, that is with minimum holding time requirements, and to provide as great a temperature differential as practicable as an aid to obtaining process heat recovery. The higher the temperature, within the permissible operating limits, the lower will be the amount of solids recirculation required to supply the retort heat needs.

The feed and recirculating heat medium shale materials admitted to the retort are in particulate form and it is desirable that the flow rates of such materials should be controlled smoothly and accurately.

The more conventional direct acting feed devices for particulate solids, including such devices as weighbelts, star feeders and plungers, are not very suitable for use in the context of the present invention and, therefore, it is preferred that the particulate admission rates should be controlled by reference to the effects caused by the respective material flows in operation of the dense phase fluid bed. Thus, in relation to the feed shale admission, it is preferred that the rate of feed be controlled by reference to the flow rate of vapour from the retort. The admission rate for the recirculating heat medium shale is preferably controlled as a function of the temperature in the fluidized bed or of the temperature of the vapour flowing from the retort.

The properties of oil produced from a particular shale are considerably influenced by the retort operating conditions, the key variables being time and temperature in the retort and the possible catalytic effects of the shale solids on the produced oils and gases. Of the key variables, time and temperature are the most important and they are also closely interrelated. Thus, if a plant design can provide a "long" residence time for the feed shale to be held at retorting conditions, then the retort temperature can be relatively "low". Conversely, a retort system that allows only a "short" residence time must have a "high" retort temperature to achieve a similar percentage of kerogen conversion. Whilst interrelated, these extremes of operating conditions are not interchangeable as they can result in quite different gas and oil yield distributions and product properties, and experience with many hydrocarbon thermal conversion processes has shown that high reaction temperatures will tend to increase gas production and decrease oil yields.

The catalytic effects of the shale on product yields and distribution are closely related to the characteristics of various feed shales and are less subject to control through plant design. Shales with high ratios of solids surface area to solids weight are considered catalytically more active than shales having lower areas. Experience with hydrocarbon processes employing catalysts suggests that yield distribution and product properties are influenced not only by the choice of catalyst but also by the reaction variables of time and temperature. Here, too, the reaction temperatures used affect the split between gas and oil product distribution.

The use of the dense phase fluid bed retorting process of the present invention facilitates flexibility in operating conditions to be used for any particular feed shale, to thus influence product distribution, yield and properties. The dense phase fluid bed when operated at a maximum bed level can use a "low" retorting temperature because a greater holding time is available for the shale solids. A retort operated with a minimum bed level can use a "high" temperature, and intermediate bed levels and temperatures can be employed as found desirable to provide optimum yields and properties.

Also, the quality of primary oil products derived from the process can be improved by selectively recycling such products back to the dense phase fluidized bed in the retort. By exposing the products to further time, temperature and possible catalytic effects in the fluidized bed, significant improvements may be obtained in the product properties, lowering pour-points, viscosities, specific gravities and boiling ranges to a greater or lesser degree as influenced by re-cycle ratios and retort operating conditions.

Therefore, in accordance with a preferred aspect of the invention, the shale oil vapours extracted from the fluidized bed are directed to a product fractionation system and at least one of the fractions obtained from such system is reintroduced into the fluidized bed either directly or together with the recirculated heat medium shale.

The invention will be more fully understood from the following description of a preferred embodiment thereof.

DESCRIPTION OF THE DRAWINGS

The description is given by way of example with reference to the accompanying drawings wherein.

DESCRIPTION OF THE PREFERRED EMBODIMENT

Figures 1A, 1B:
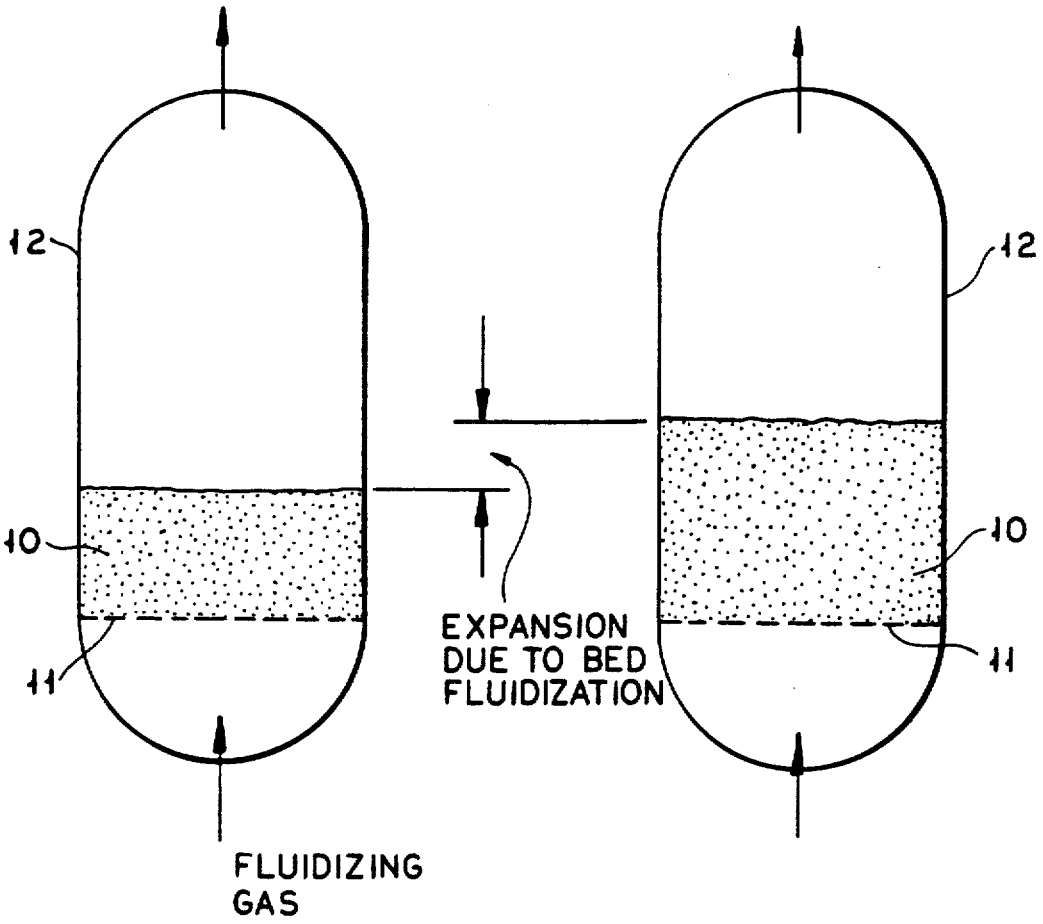
FIGS. 1A and 1B show the principles applicable to dense phase fluidization.

Before proceeding to the detailed description of the present invention, brief reference is made to FIGS. 1A and 1B of the drawings which illustrate a classical fluidized bed. A bed of finely divided solids 10 is retained upon a supporting screen 11 in a pressure vessel 12 and, as shown in FIG. 1B, the bed is expanded to a greater volume than that which the solids alone would occupy by an up-flowing stream of gas or vapour. The gas velocity is selected to be slightly greater than a lower limit that causes a pressure differential across the bed in pressure units per unit of area equal to the weight of the bed per unit of area, but the gas velocity is below an upper limit where the bulk of the solid particles of the bed would be entrained and carried away so that the bed would not be retained on its support. Beds of particulate material which are operated within these limits are said to be in "dense phase fluidization".

The present invention utilizes a dense phase fluidized bed in the retorting of oil shale but, unlike the classical fluidized bed, the present invention is directed to a shale oil recovery system in which a dense phase fluidized bed is created by contacting feed shale with recirculated heat medium shale which is delivered to the bed at a temperature sufficient to cause conversion of the kerogen contents of the fresh feed shale particles into gas and oil vapour products in the bed. Thus, a fluidizing medium is generated within the bed and is constituted by gas and vapour products which are released in the kerogen conversion process.

Figure 2:
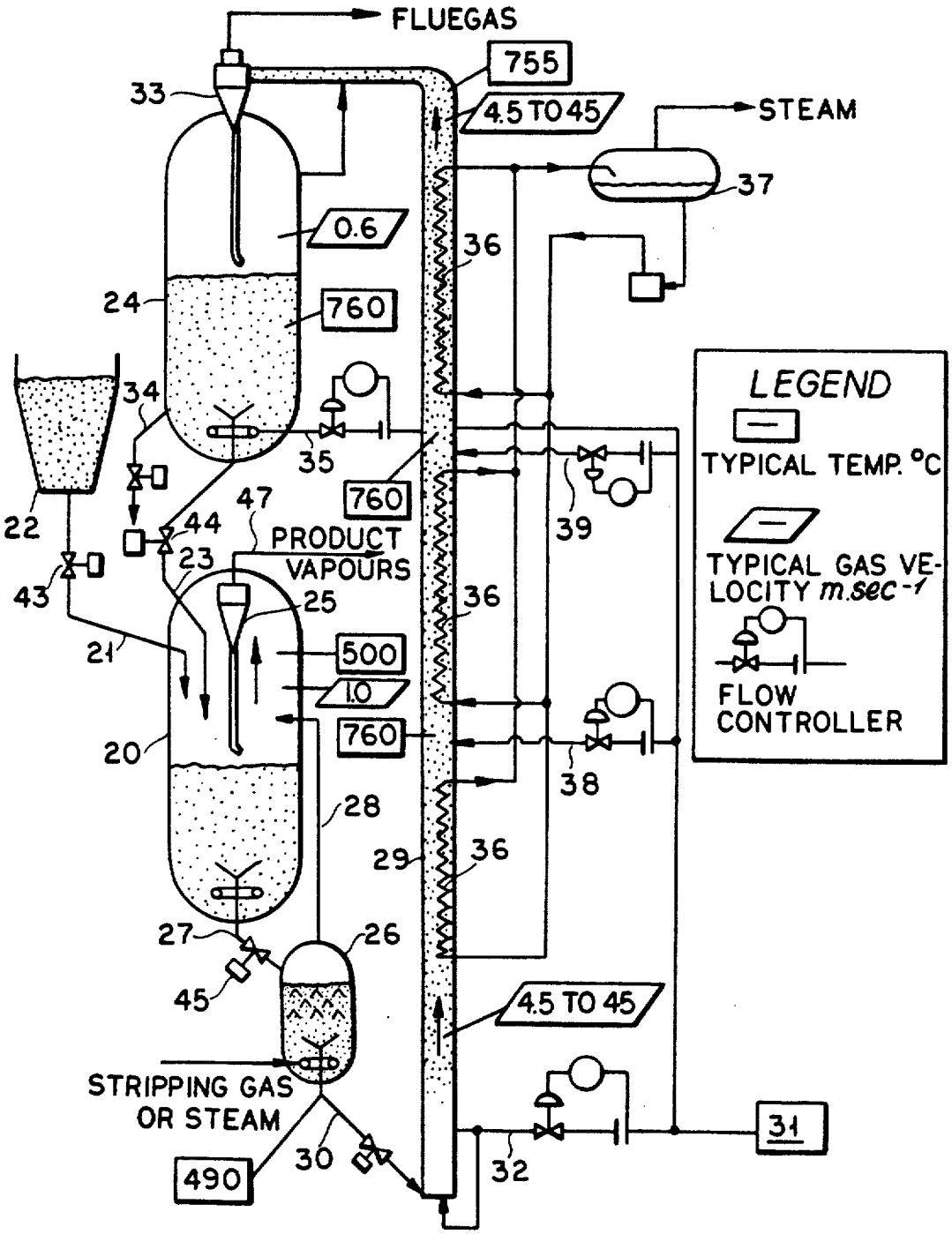
FIG. 2 shows a schematic representation of a shale oil recovery plant incorporating the features of the present invention.

As shown in FIG. 2 of the drawings, the shale oil recovery plant of the present invention comprises a retort 20 into which fresh particulate feed shale is delivered, by way of a feed line 21 from a surge bed 22. The feed material is pre-crushed to particulate sizes of approximately 6 mm or less, and the rate of delivery of the feed shale is controlled in a manner which is to be hereinafter described.

Recirculating heat medium shale is also delivered to the retort 20 at a controlled rate, the heat medium shale being supplied via a feed line 23 from a dense phase fluidized surge bed which is contained within a vessel 24. The heat medium shale is delivered to the retort 20 in sufficient quantity to effect retort temperature and holding time conditions to convert the kerogen content of the feed shale into gas and oil vapour products which are released at all levels throughout the bed of particulate material within the retort 20 and, thus, as above stated, a fluidized bed is created without there being a need to inject a fluidizing medium from an external source.

Figure 4:
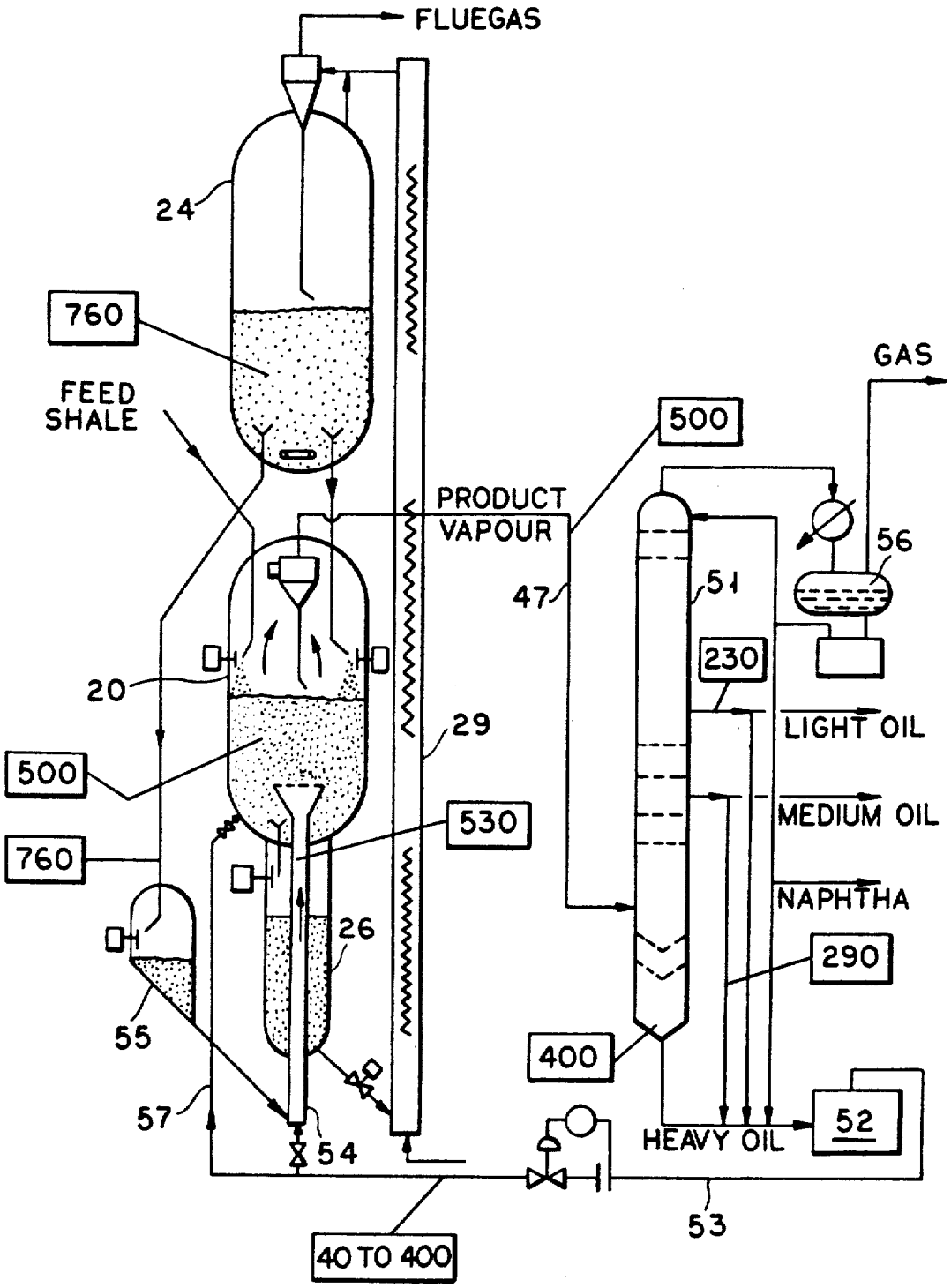
FIG. 4 shows a schematic representation of a shale oil recovery plant which is similar to that illustrated in FIG. 2 but which incorporates a product re-cycling system.

Gas and oil vapour which migrates above the fluidized bed in the retort 20 is drawn from the retort by way of a cyclone separator 25 and is delivered to a product fractionating system (as shown in FIG. 4) for subsequent processing to final or transportable products.

Spent feed shale and recirculating heat medium shale progressively passes from the fluidized bed within the retort 20 and enters a stripping vessel 26 by way of a valved feed line 27. Residual gas and oil vapour which is entrained in the particles which progress into the stripping vessel 26 are stripped from the particles by gas or steam which is injected into the stripping vessel, and the resulting gas and oil vapours are directed into an upper region of the retort 20 by way of a delivery line 28.

The stripped spent shale and recirculating heat medium shale are thereafter passed from the stripping vessel 26 to a dilute phase transport combustor 29 by way of a valved feed line 30.

The transport combustor 29 is constituted by a dilute phase burner into which the recirculated heat medium and spent feed shale is directed and in which residual carbon on or in the spent shale is burned in the presence of combustion supporting air. Thus, in contrast with the dense phase fluidized bed which is established within the retort 20, the transport combustor 29 functions as a dilute phase device into which fluidizing air is directed by a blower 31.

Air from the blower 31 is admitted to the lower region of the transport combustor 29 by way of a controlled delivery line 32 and the air entrains the spent feed shale and the recirculating heat medium shale from the stripping vessel and carries the shale particles along the length of the transport combustor 29. During the particle residence time in the combustor 29, the residue carbon on and in the shale is burned in the presence of the entraining air, and the heat of combustion raises the temperature of the particles to the level required to effect the fluidized bed retorting in the retort 20. When the spent shale particles enter the transport combustor and are elevated in temperature, such particles may be regarded as being recirculating heat medium shale because they are thereafter directed, at an elevated temperature, into the surge bed vessel 24 and into the retort 20 together with previously recirculated heat medium shale.

Having passed through the transport combustor 29, the recirculating heat medium particles and the entraining gas is delivered to a cyclone 33 which functions to separate the solid particles from the gas. The entraining gas and air which exits from the surge bed 24 is expelled as "flue" gas and the solid particles (i.e., the recirculating heat medium shale particles) are directed into the surge bed 24 for subsequent transfer into the retort vessel 20.

In summarizing the operation of the cycle described thusfar, fresh feed shale is fed into the retort 20 (along with recirculating heat medium shale) and the feed shale is progressively converted into spent feed and then into recirculating heat medium shale which may be re-cycled many times over through the dense phase fluid bed in the retort 20. However, as more feed shale is progressively fed into the retort 20, a proportion of the recirculating heat medium shale is discarded from the surge bed 24 by way of a discharge line 34. The rate at which discharge of the net accumulation of spent shale occurs is determined in the long term by the rate of delivery of fresh feed shale.

Air from the blower 31 is delivered to the surge bed 24 by way of a delivery line 35. Such air acts as a fluidizing medium in the surge bed 24 and also serves to support combustion of part or all of any carbon residue remaining on the shale.

Heat exchange coils 36 are located within the transport combustor 29 and serve to utilise combustion heat which is generated in excess of that required by the recirculating heat medium shale to sustain fluidized bed retorting in the retort 20. The heat exchangers 36 are connected in circuit with a source 37 of water and they function to generate steam for use in the oil recovery plant or in associated equipment.

Also, air from the blower 31 is directed, by way of delivery lines 38 and 39, into the transport combustor at intervals along its length. The air is delivered to the transport combustor by way of the lines 38 and 39 in controlled amounts, and such multi-stage addition of air avoids the creation of an excessively high temperature which might result if all of the combustion supporting air were to be directed into the inlet end of the transport combustor.

The heat exchangers 36 remove heat from the recirculating heat medium shale particles and from the entraining gas while the added air from the lines 38 and 39 allows the combustion of corresponding amounts of carbon in order to hold the transport combustor temperature at a high level close to the maximum operating limits. This ensures that carbon combustion on and in the spent shale particles will occur at a high rate, with a minimum holding time requirement, and provides for as great a temperature differential as practicable as an aid to process heat recovery.

Typical temperatures and gas flow velocities which apply in various parts of the plant which has been described thus far are shown in FIG. 2 of the drawings, but it will be appreciated that the indicated temperatures and gas flow velocities should be treated solely as exemplary and not as being limiting on the invention.

Figure 3:
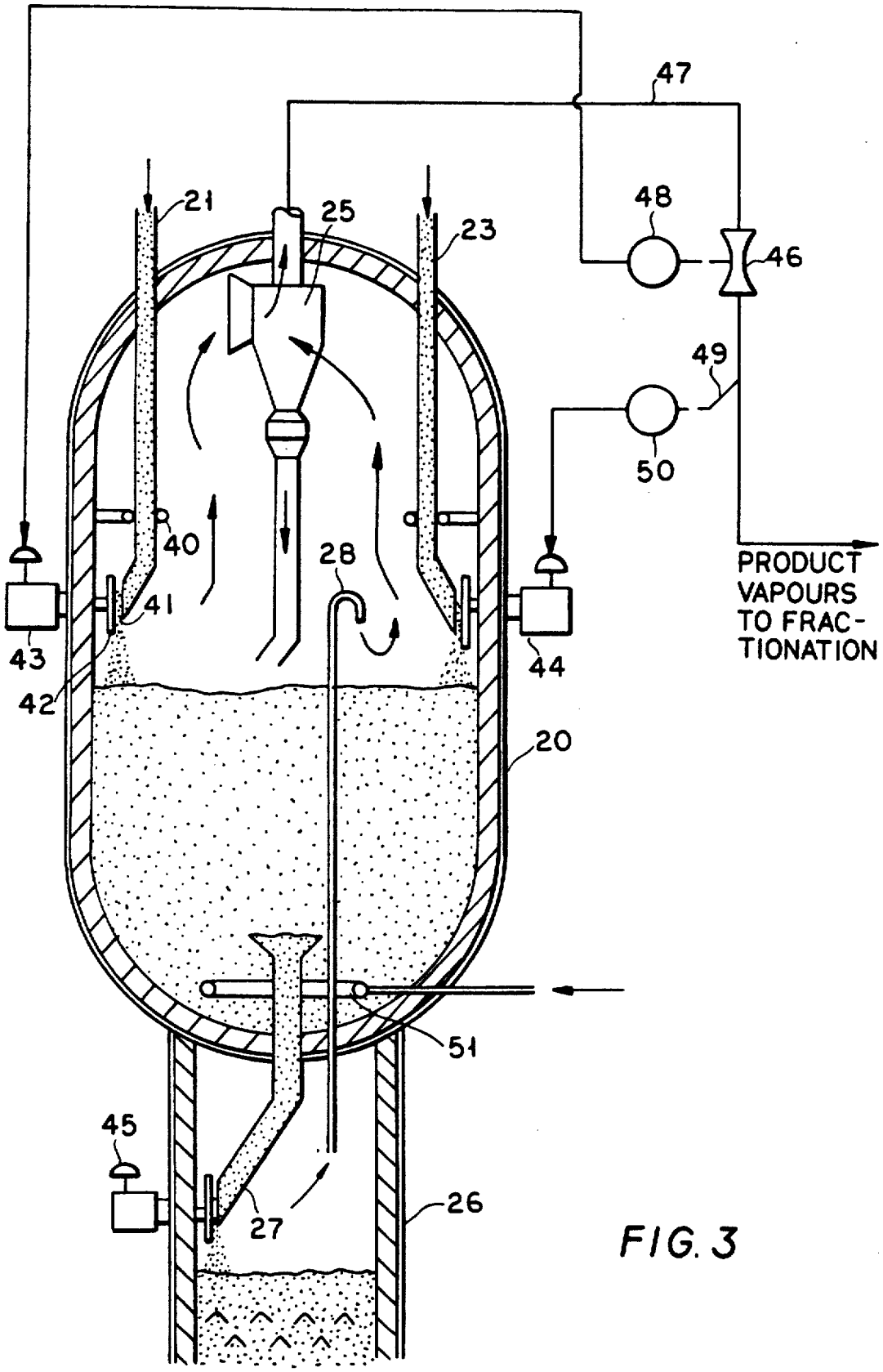
FIG. 3 shows a more detailed but nevertheless schematic view of a dense phase fluidized bed retort portion of the plant which is illustrated in FIG. 2.

Reference is now made to FIG. 3 of the drawings which shows the retort 20 in greater detail and which shows certain previously unmentioned features of the construction and operation of the retort.

The feed shale delivery line 21 projects into the retort vessel 20 and is slidably supported in a bearing 40, so that temperature induced expansion of the feed line can be accommodated. Also, the lower end of the feed line is mitered so as to present a valve "seat" 41 to a valve member 42. The valve member 42 is in the form of a disc which is actuated in a direction toward and away from the seat 41 by a pneumatically, hydraulically or electrically driven valve positioner 43 which is located outside of the retort vessel 20, The total valve structure which is illustrated in FIG. 3 functions as a feed shale delivery throttle control valve and it offers considerable advantage over conventional types of control valves. It can be constructed from materials which will withstand the abrasive influence of shale particles, it is of simple but rugged construction, and it has its operating mechanism disposed outside of the retort vessel 20 where it is divorced from the harsh environment which exists within the retort vessel.

A similar valve arrangement, which is identified generally by numeral 44, is provided for controlling delivery of the recirculating heat medium shale into the vessel by way of the feed pipe 23.

Furthermore, a similar valve arrangement 45 is provided for controlling the rate of transfer of spent and recirculating heat medium shale from the retort 20 to the stripping vessel 26.

In an alternative form of this valve, where the feed pipes (e.g. 21 or 23) are long and flexible, the valve member may be fixed and the lower end of pipe, incorporating the seat, may be moved toward and away from the valve member.

The primary variable which determines the required rate of delivery of fresh feed shale, and hence the operation of the control valve 43, is the product flow rate from the retort 20. Therefore, a flow detection element 46 (which incorporates a venturi or other nozzle that can tolerate the erosion propensities of shale particulates) is located in the product delivery line 47 and is coupled with a flow controller 48. The flow controller 48 provides a output signal which varies as a function of the product flow rate through the line 47, and the output signal is delivered as a control signal to the valve 43.

Thus, a detected product flow rate which is less than a predetermined required flow rate will indicate that a greater volume of feed material is to be delivered to the retort via the feed line 21 and, therefore, the valve 43 will be actuated to admit a greater quantity of feed material into the retort 20. Conversely, if a product flow rate through the line 47 exceeds a predetermined required flow rate, the valve 43 will be actuated so as to restrict the quantity of feed material delivered to the retort 20 by way of the feed pipe 21. The required flow rate of product from the retort 20 will be predetermined to satisfy optimum operating conditions of the plant having regard to the kerogen content of feed shale to be processed by the plant.

The temperature of the retort bed or the temperature of the oil vapour in the product delivery line 47 can be used as the primary variable for determining the rate at which the recirculating heat medium shale is delivered to the retort 20 by way of the feed pipe 23. Thus, a thermo-couple 49 may be located within the retort bed or, as shown in FIG. 3, in the product delivery line 47, for the purpose of applying an input to a temperature controller 50 which, in turn, provides an output control signal to the valve 44.

The temperature of oil vapour in the product line 47 is determined primarily by the volume of recirculating heat medium shale in the fluidized bed (assuming that the volume of fresh feed shale remains substantially constant) and, thus, if the measured temperature is greater than a predetermined temperature, an indication is obtained that an "excessive" amount of heat medium shale is resident in the bed. Under such condition, the output signal from the temperature controller 50 causes closure of the valve 44 and restriction of the flow of heat medium shale into the retort. Conversely, if the temperature of the oil vapour in the product delivery line 47 falls below a predetermined level, indication is thereby provided that further heat medium shale should be admitted to the retort 20 and, under such circumstance, the output signal from the temperature controller 50 functions to cause the valve 44 to open so that the heat medium shale may be fed to the retort by way of the feed pipe 23 at an increasing rate.

The above described system provides for accurate control of the fresh feed shale and recirculating heat medium shale feed rates and, additionally, provides the advantage of being self-compensating for variations in the grade of fresh feed shale.

The weight percentage of Kerogen in "as mined" shale varies and any attempt to segregate shales by grade, so that shale of uniform quality may be fed to the retorting plant, will involve a high additional operating cost. Also, with the known (prior art) direct volumetric mechanical feed control methods, abrupt shale grade changes could cause serious operating upsets in the retort.

In the system of the present invention, with product flow being used to control the rate of feed addition to the retort, a lower grade of shale will result in opening of the feed control valve, so that the required Kerogen input is maintained, and the temperature controller will cause the hot shale throttle valve to open so that additional heat will be provided to satisfy the greater rate of feed of the fresh feed shale.

As is also shown in FIG. 3 of the drawings, a manifold 51 is located in the lower region of the retort vessel 20 and a fluid delivery line is connected with the manifold for directing supplementary fluidizing gas into the retort vessel under start-up conditions. The supplementary fluidizing gas may comprise steam, re-cycled product gas, or re-cycled oil as may be found most convenient or economic. When the normal operating conditions of the bed in the retort vessel 20 have been established, the dense phase fluidized bed will be self sustaining, as hereinbefore stated, and delivery of the supplementary fluidizing medium may thereafter be terminated or be sharply reduced. However, it will be necessary to deliver a small flow of purge fluid to the manifold when normal operating conditions exist, so as to prevent solids from entering and plugging the manifold.

Reference is now made to FIG. 4 of the drawings which shows a recovery plant which incorporates all of the above described features but which also incorporates a product fractionation/improvement system.

Oil and gas vapour from the retort vessel 20 is delivered to a fractionating column 51 and the various fractions of the product are then collected. Gas products from a reflux drum 56 may be routed to a low pressure handling system or be compressed as fuel, and liquid naphtha products will be pumped from the reflux drum for subsequent processing or transportation. The other liquid products are also discharged for downstream processing or transport. However, as shown in the drawing, a proportion of the liquid products, naphtha through to heavy oil, may be recycled back through the retort vessel 20 by way of a return pump 52.

One or the other or both of the re-cycling circuits shown in FIG. 4 may be incorporated in the recovery plant. Thus, the re-cycled product alone may be fed into the fluidized bed in the retort vessel 20 by way of return lines 53 and 57, or the re-cycled product may be used to entrain some of the recirculating heat medium shale and enter the retort as a vapour/particle mixture flowing up line 54. In the latter case, a secondary solids surge vessel 55 may be interposed between the primary surge vessel 24 and the return line 54 as a means for smoothing solids flow control. In either case, the re-cycled product will act as a supplementary fluidizing medium when it enters the retort 20, although such recycling is not intended for the specific purpose of effecting fluidization in the retort but, rather, for effecting "improvement" of the oil by reforming, cracking, viscosity breaking or pour-point lowering as desired.

A distinction between the above described re-cycling provisions is to be noted. Re-cycled oil fractions which are returned directly to the dense phase retort fluid bed 20 will merely be exposed to additional time at the reactor temperature that prevailed when the fractions were converted from the kerogen in the feed shale in the retort. It is expected that this will produce relatively mild changes in the properties of the re-cycled oil. In the alternative approach, where the re-cycled oil is contacted with hot heat medium shale in the line 54 before it gets back into the retort, a more flexible type of operation is involved. By using enough hot heat medium shale, the oil temperature can be raised to whatever may be optimum for that particular oil fraction, that is to a temperature that may be well above the level desirable for the fluid bed retort itself. This will provide an excellent thermal cracking system for the re-cycled oil, with overtones through the possible catalytic effects of the shale solids. Depending on the severity of cracking practiced, the re-cycled oil may be changed into products which vary only a small amount from the primary oil product to products which differ quite markedly from the primary oil product.

Re-cycling of heavy oil from the fractionating plant provides the further important advantage of returning entrained solids back to the fluidizing bed. This function is independent of the extent of conversion desired for the heavy oil. The heavy oil could be directed into the retort near the upper level of the fluidizing bed, or it could be converted essentially to extinction by what would amount roughly to a fluid coking type operating.

The above described plant offers certain advantages (which have not previously been mentioned) in relation to the preparation of fresh shale which is to be fed to the retort. Although it is intended that the feed material should be crushed to a particle size falling within a range that may be readily fluidized in the various stages of the plant, it is anticipated that a certain amount of oversized particles may enter the plant with the feed shale. A feature of the above described plant design is that such random oversized particles may be accommodated without incident. Oversize particles which are too large to be fluidized will merely "sink" through the feed surge, retort and stripper dense phase beds to enter the dilute phase high velocity transport combustor and be carried upward to enter the combustor surge dense phase bed. At this point, the oversize particles will divide into portions that leave with the recirculating heat medium shale and a proportionate fraction that leaves with the spent shale discard stream. The flow of solids is nowhere required to pass over a low spot or weir that would constitute a "large particle trap", and this means that oversize particles will get at least a relative amount of time exposure to the operating conditions prevailing in the plant and will provide a yield of products and of carbon fuel for combustion. This, in turn, means that crushing plant operation and control should be less critical, and it may mean that the combination of crushing plant and retort plant will provide a higher shale throughput and product yield than would be the case if the retort system could not handle oversize particles.

In general, however, it is preferred to keep the size of the feed particles less than 6 to 7 mm diameter and more preferably less than 4 mm diameter. It is also desirable to maintain the velocity of the particles and gas in the dense phase fluidized bed at about 2 feet/second. This velocity could go as high as 3 to 4 feet/second without serious problems from entrainment of particles in the effluent vapour, but higher velocities (commonly used in other fluidized beds) such as 10–15 feet/second should be avoided.

These required velocities, in conjunction with required output, will determine the size of the retort which is necessary to maintain the self supporting dense phase fluidized bed. As a typical example, a 50 foot diameter retort incorporating a dense phase fluidized bed with gas and particle velocities of approximately 2 feet/second would give an output of approximately 50,000 barrels/day.

What we claim is:

1. A method of recovering oil from solid hydrocarbonaceous material which comprises the steps of:

contacting fresh feed hydrocarbonaceous material particles with heat transfer particles in a dense phase fluidized bed, the fluidization of said dense phase fluidized bed being established during an initial start-up period by injecting a fluidizing medium into a dense phase bed of particles, and following said initial start-up period the fluidizing medium for the bed being retained within the bed and being generated at least primarily by fluid released by conversion of kerogen in the feed material and without there being a need to inject a fluidizing medium into the bed from an external source, withdrawing from the bed oil vapour which is produced as a result of heat exchange between the heat transfer particles and the feed particles, progressively withdrawing the heat transfer particles and spent feed material particles from the fluidized bed, heating the heat transfer particles in a heating region external of the fluidized bed, and recirculating the heated particles through the fluidized bed with fresh feed material particles.

2. A method as claimed in claim 1 wherein said heat transfer particles comprise recirculated spent feed material particles.

3. A method as claimed in claim 2 wherein said recirculated spent feed material particles are heated by burning residual carbon therein in the presence of a combustion supporting gas.

4. The method as claimed in claim 1, wherein the fresh feed hydrocarbonaceous particles are admitted to the fluidized bed at a rate which is a function of the flow rate of oil vapour product which is withdrawn from the fluidized bed, wherein a decrease in flow rate of oil vapour product results in an increase in feed rate of fresh shale particles to the fluidized bed.

5. A method according to claim 1, wherein the fluidizing medium injected into the dense phase bed of particles during the initial start-up period is selected from the group consisting of steam, and a fuel gas.

6. A method according to claim 1, wherein the fluidizing medium injected into the dense phase bed of particles during the initial start-up period is steam.

7. A method according to claim 1, wherein the fluidizing medium injected into the dense phase bed of particles during the initial start-up period is an inert gas.

8. A method of recovering shale oil from oil shale comprising the steps of:

contacting feed shale particles with recirculated heat transfer shale particles in a dense phase fluidized bed with a fluidizing medium for the bed being generated by and retained within the bed and being constituted at least primarily by fluid released by conversion of kerogen in the shale particles and without there being a need to inject a fluidizing medium into the bed from an external source, withdrawing from the fluidized bed shale oil vapour which is produced as a result of heat exchange between the heat transfer shale and the feed shale particles, progressively withdrawing the heat transfer shale and spent feed shale particles from the fluidized bed, heating said heat transfer shale and spent feed shale particles in a region external of the fluidizing bed, and recirculating the heated particles through the fluidized bed with fresh feed shale particles, wherein the fresh feed shale particles are admitted to the fluidized bed at a rate which is controlled as a function of the flow rate of oil vapour which is withdrawn from the fluidized bed wherein a decrease in flow rate of oil vapour results in an increase in feed rate of fresh shale particles to the fluidized bed.

* * * * *